US007601903B1

(12) United States Patent
Monk

(10) Patent No.: US 7,601,903 B1
(45) Date of Patent: Oct. 13, 2009

(54) DRUM STICK HOLDER

(75) Inventor: Elmer W. Monk, Cincinnati, OH (US)

(73) Assignee: Elmer Monk

( * ) Notice: Subject to any disclaimer, the term of this patent is extended or adjusted under 35 U.S.C. 154(b) by 0 days.

(21) Appl. No.: 12/157,910

(22) Filed: Jun. 13, 2008

(51) Int. Cl.
*G10D 13/02* (2006.01)

(52) U.S. Cl. ..... 84/422.4; 84/421

(58) Field of Classification Search ..... 84/421, 84/422.4

See application file for complete search history.

(56) References Cited

U.S. PATENT DOCUMENTS 5,435,220 A 7/1995 Pultz
5,522,300 A * 6/1996 Cheatwood ..... 84/453
5,551,660 A 9/1996 Leduchowski
6,150,595 A 11/2000 Vaglica

* cited by examiner

*Primary Examiner*—Kimberly R Lockett

(57) ABSTRACT

A drummer's drumstick holder is disclosed comprising a rigid, circumscribing frame having a woven web of elastic bands therein forming a matrix of openings within which the drumsticks may be inserted. The frame is secured to the drum set by elastic straps affixed to the drum set and/or other accompanying instrumental pieces.

5 Claims, 7 Drawing Sheets

DRUM STICK HOLDER

TECHNICAL FIELD OF THE INVENTION

The present invention relates to a musical instrument accessory; more particularly to an improved drumstick holder for a drummer's use during a musical performance.

BACKGROUND OF THE INVENTIONS

During a given musical performance a drummer typically uses more than one set of drumsticks. A different weight and/or type of drumstick may be used for different parts of a musical piece being played to obtain differing sound effects. Thus a drummer needs a means to have a variety of drumsticks readily at hand whereby he may instantly exchange drumsticks while performing.

Heretofore, attempted solutions to the drumstick swapping problem generally comprised some sort of tray, or tube-like container that would be attached to the drummer's drum set or positioned within close proximity. For example see U.S. Pat. Nos. 5,435,220; 5,551,660; and 6,150,595. Drummers have also employed the use of "stick bags" attached to their drum set and/or fastened to their person by means of a belt or the like.

Nevertheless, the need continues for a more desirable solution to the stockholder problem whereby the drummer may swap, or exchange, drumsticks quickly during a given performance.

SUMMARY OF THE INVENTION

The present invention provides the drummer a drumstick holder that may be easily attached to his drum set and thereby readily available for placement of drumsticks therein and/or removal therefrom as the need arises during performance of a musical piece.

The herein taught drumstick holder basically comprises a rigid, circumscribing frame having a woven elastic band web therein forming a matrix of openings within which the drumsticks may be inserted. The frame is secured to the drum set by elastic straps that are affixed to the drum set and/or other instrumental pieces.

DETAILED DESCRIPTION OF THE INVENTION

Figure 1:
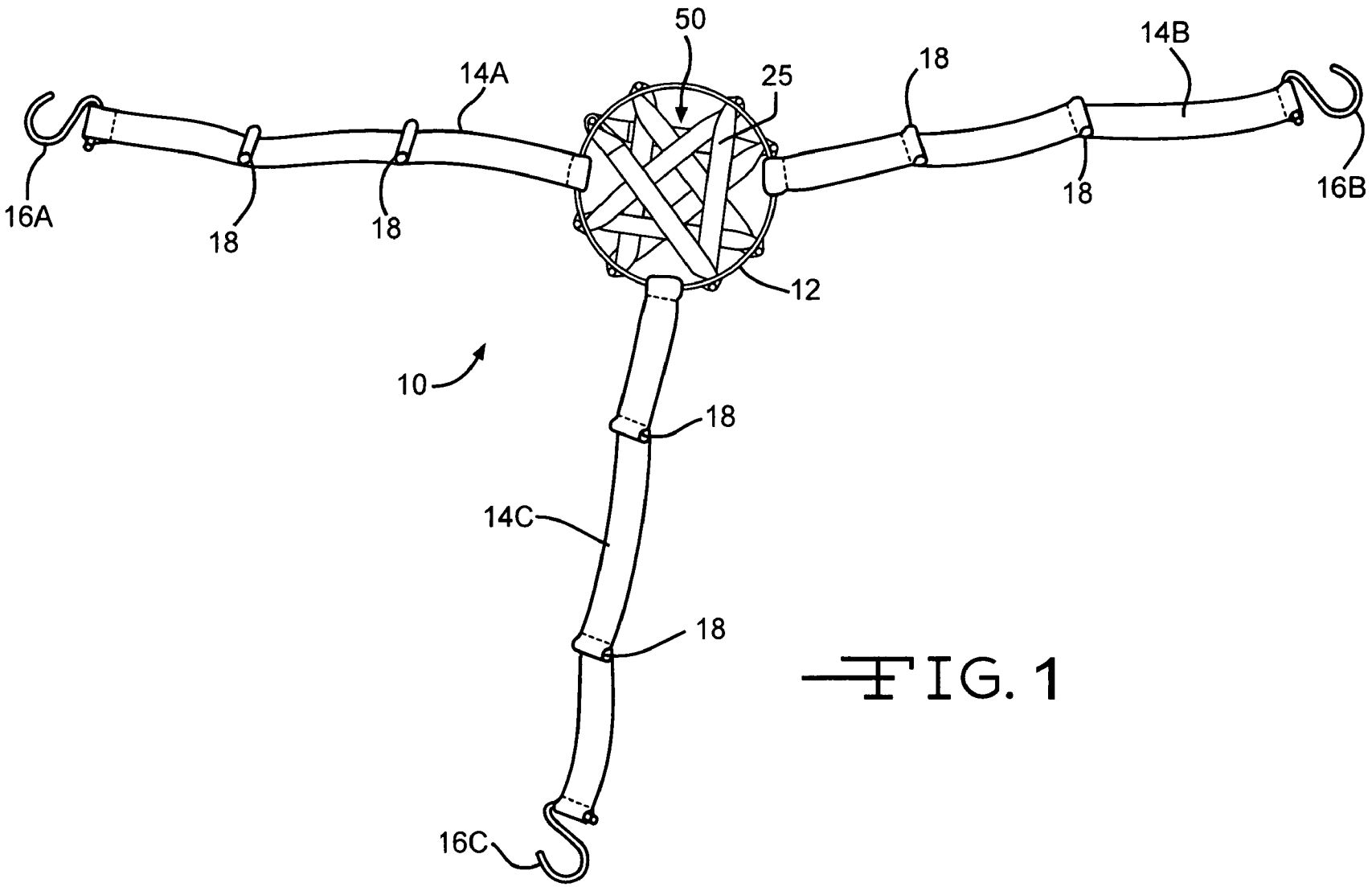
FIG. 1 presents a plan view of my drumstick holder.

FIG. 1 shows the basic components of my unique drumstick holder. Drumstick holder 10 comprises an assembly having a main circular frame, or ring, 12 having at least three, spaced apart, elastic straps 14A, 14B, 14C attached thereto as illustrated in FIG. 1. An S link, or hook, 16 is provided at the terminal end of each strap, the function of which will be further explained below.

Each elastic strap 14 includes at least one sewn-in loop 18; the function of which will be explained further below.

Figure 2:
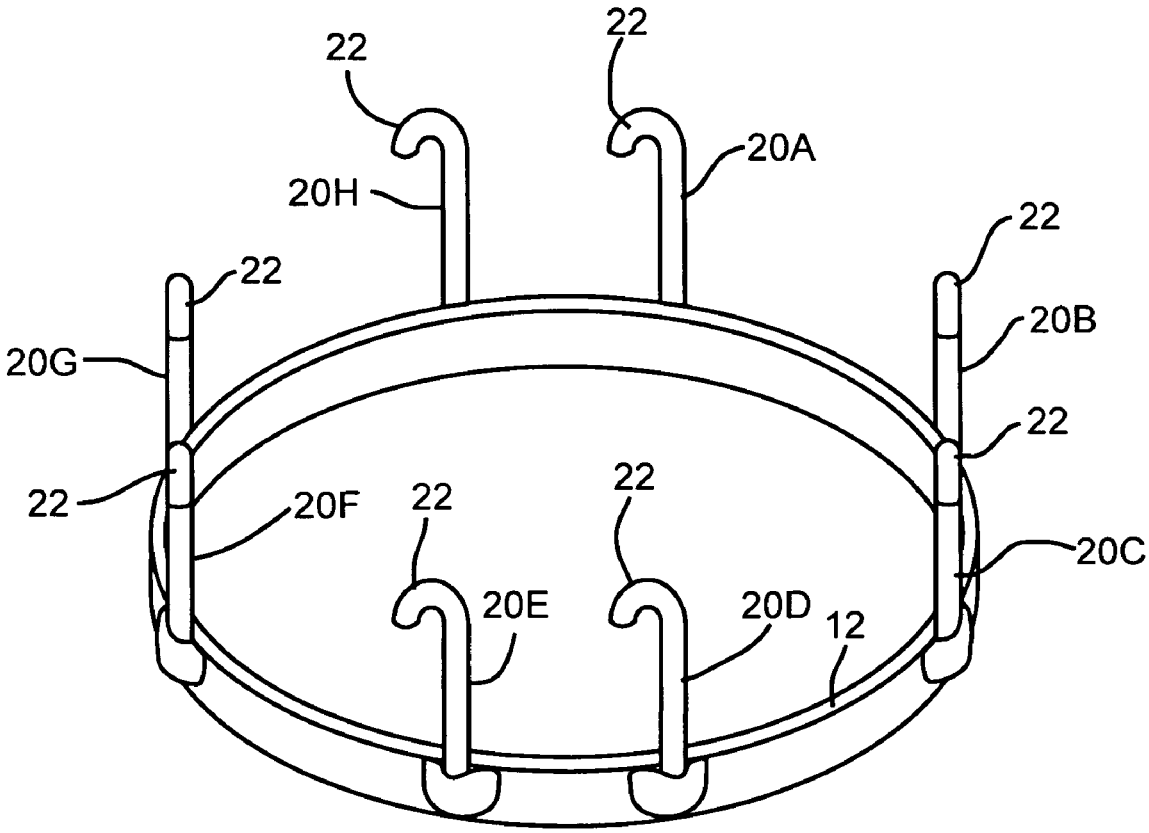
FIG. 2 presents an inverted, pictorial view of the center frame of the drumstick holder illustrated in FIG. 1.
Figure 3:
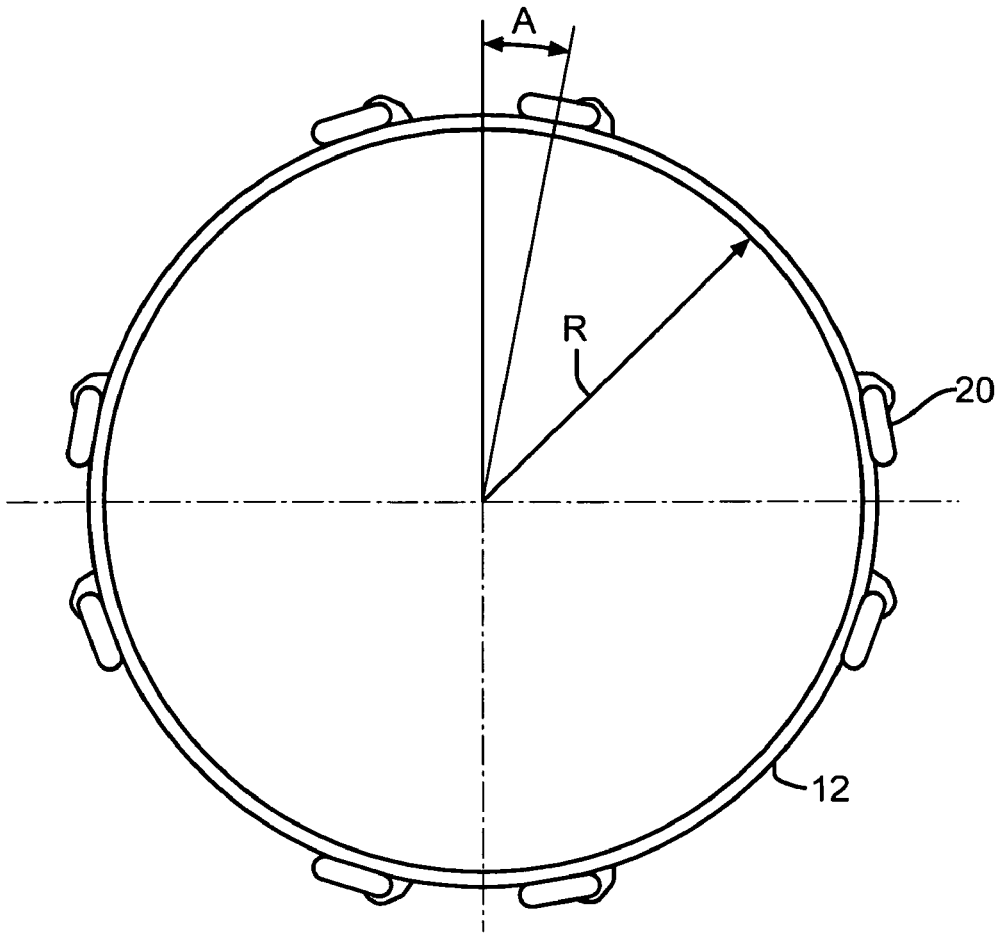
FIG. 3 presents a top plan view of the center ring illustrated in FIG. 2 with center webbing and elastic straps removed.
Figure 4:
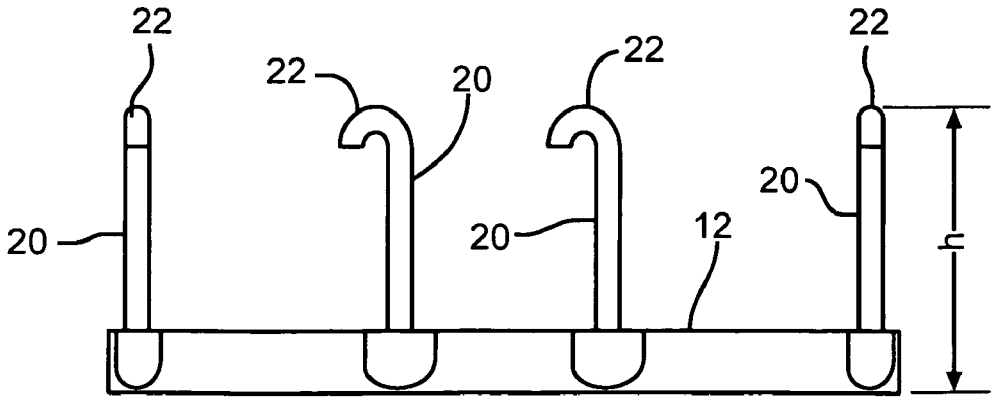
FIG. 4 presents a side elevational view of the center ring illustrated in FIG. 2.

Referring now to FIGS. 2 through 4, FIG. 2 presents an inverted, pictorial view of ring assembly 12 while FIGS. 3 and 4 respectively, present a top and elevational view of ring assembly 12 as illustrated in FIG. 2. Positioned about the circumference of ring 12 are eight extending posts 20. Posts 20 are affixed to ring 12 by any suitable manner such as welding. At the terminal end of each post 20 is a hook like means 22. Posts 20 are preferably grouped in pairs, as illustrated in the figures, with a pair of posts positioned at the 0, 90, 180, and 270 degree location about ring 12 as illustrated.

Ring 12 is preferably made of ⅛ steel having a radius R of approximately 1.6 inches. However, it may be any suitable or convenient size to suit the user. Posts 22 are approximately 1.0 inch in length h, although posts 22 are generally of a length to suit the width of elastic band 52 used to create the weave 50 within ring 12. As illustrated in FIG. 3 each pair posts 20 are offset by angle A of approximately 10 degrees.

Figure 5:
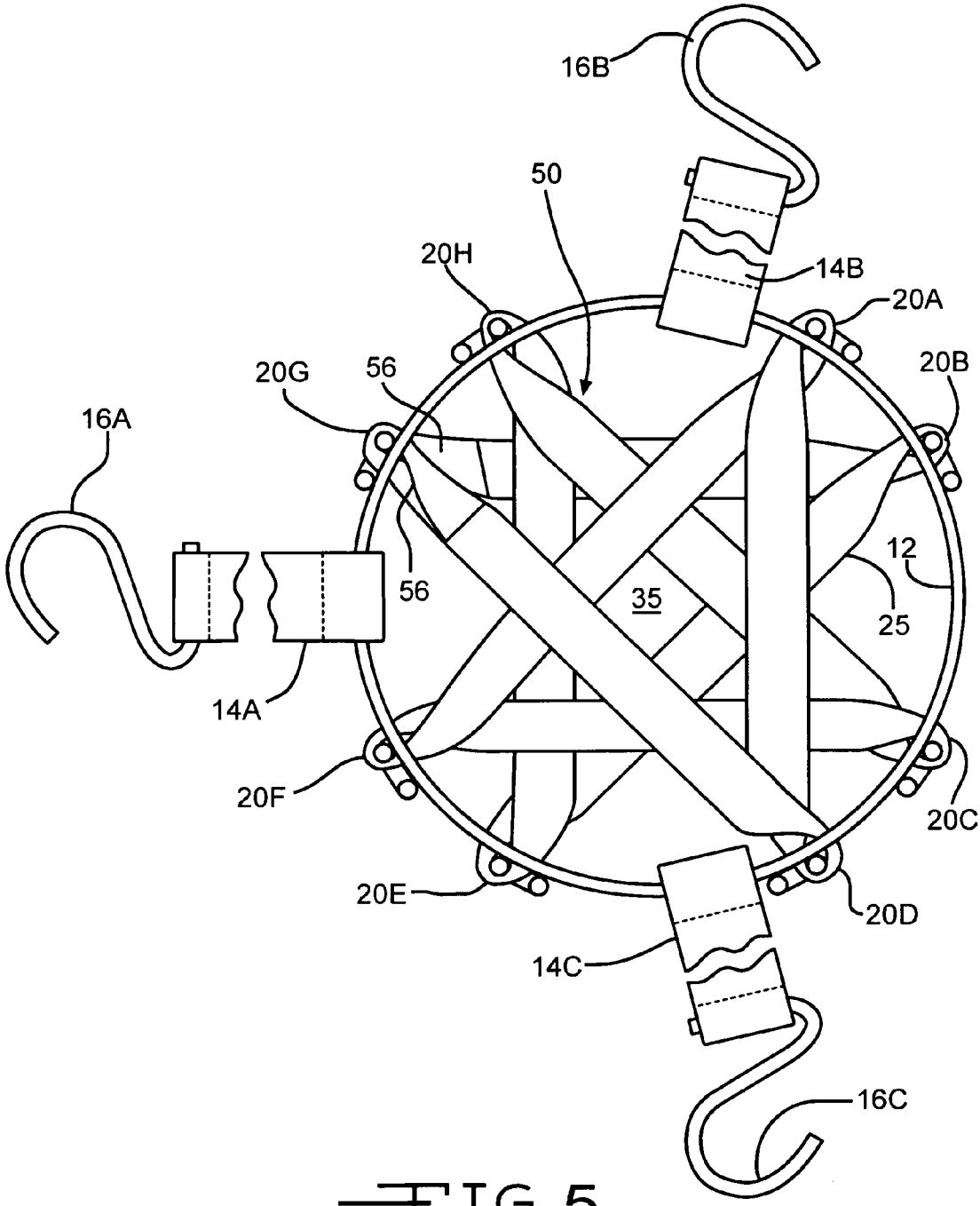
FIG. 5 presents a top plan view of the center ring having elastic webbing and straps attached thereto.
Figure 6:
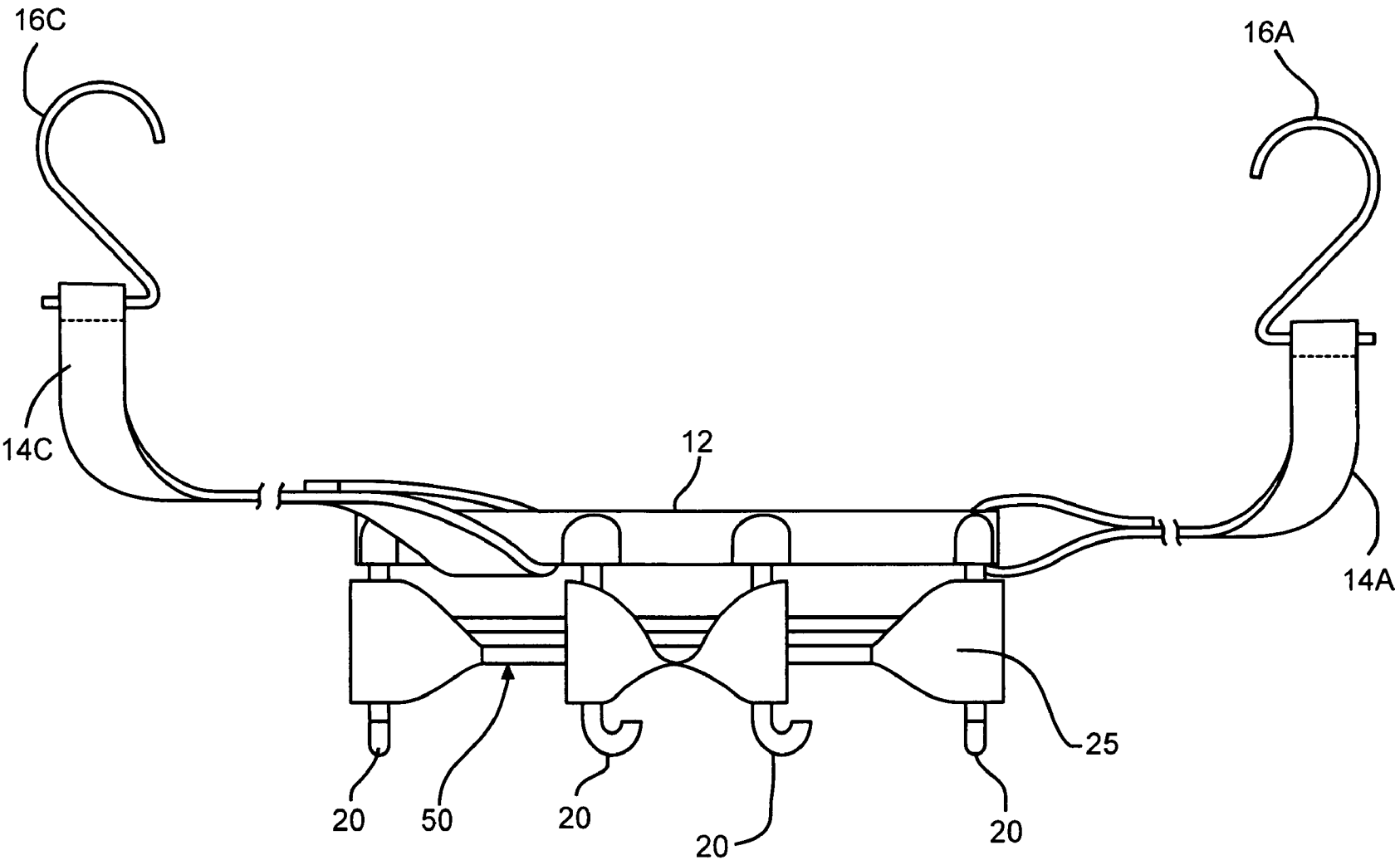
FIG. 6 presents an elevational view of the center ring illustrated in FIG. 5.

Referring now to FIG. 5. FIG. 5 shows a continues elastic band 25 stretchingly woven in a generally diametric, crisscrossing pattern about posts 20 whereby a multiplicity of open spaces 35 are formed within ring 12. Elastic band 25 is an elongated elastic band having a width of approximately ½ inch and a length suitable to complete the weave as shown within ring 12. A sewn in loop is provided at each end of elastic band 25

Referring to FIG. 5, a suitable weaving sequence and pattern for forming woven matrix 50 within ring 12 follows: first, one looped end 56 of elastic band 25 is attached to post 20G, elastic band 25 is then, stretchingly, wrapped about post 20D. Then about post 20A followed by wrapping elastic band 25 about post 20F. Next elastic band 25 is wrapped about post 20C, then about post 20H followed by 20E to 20B followed by looping the final looped end 58 upon post 20G.

It is not only desirable to use the weaving sequences as described above but also desirable to interweave the strands as illustrated.

Figure 7:
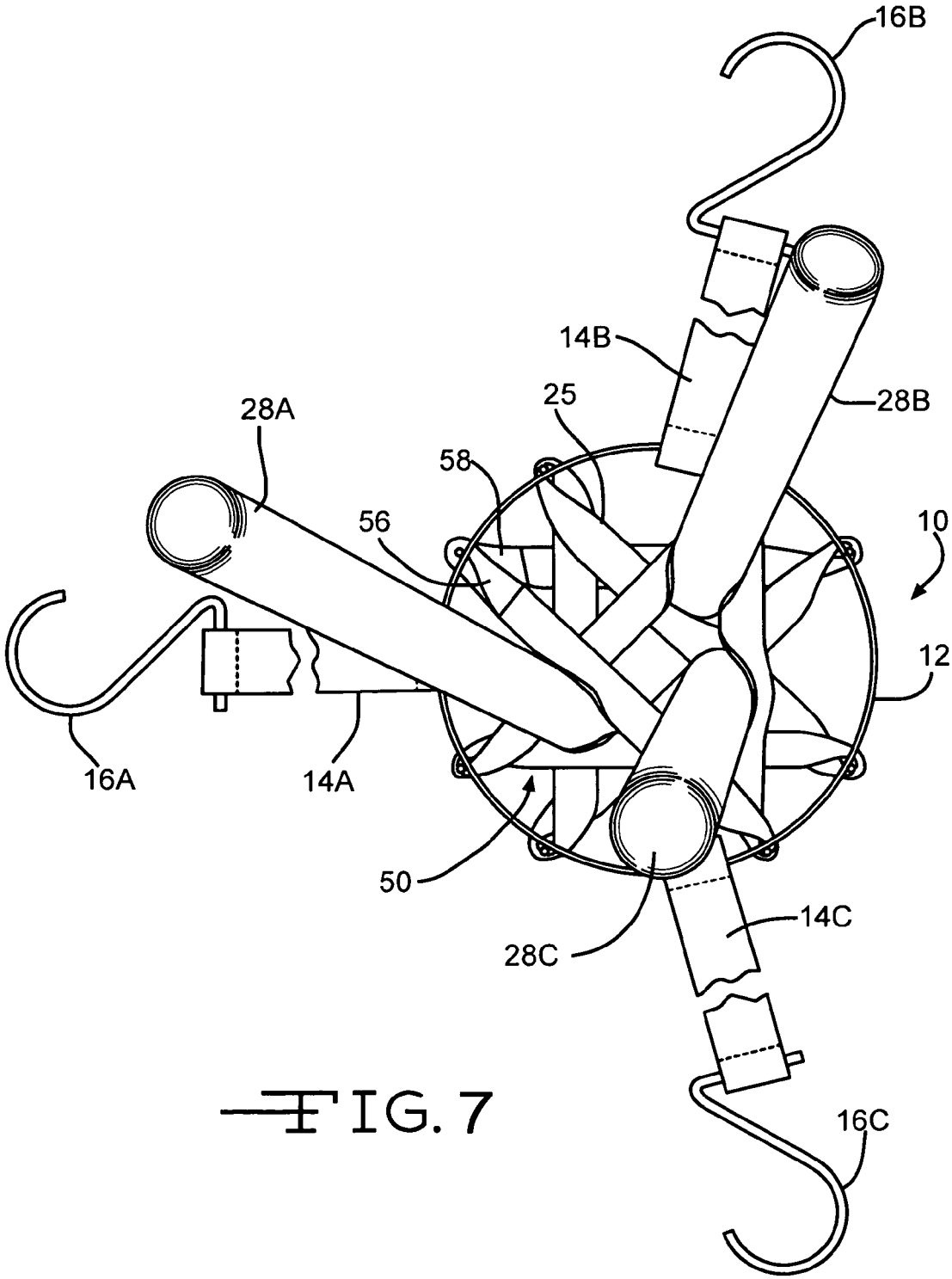
FIG. 7 presents a top view, similar to that of FIG. 5, having three drumsticks inserted therein.
Figure 8:
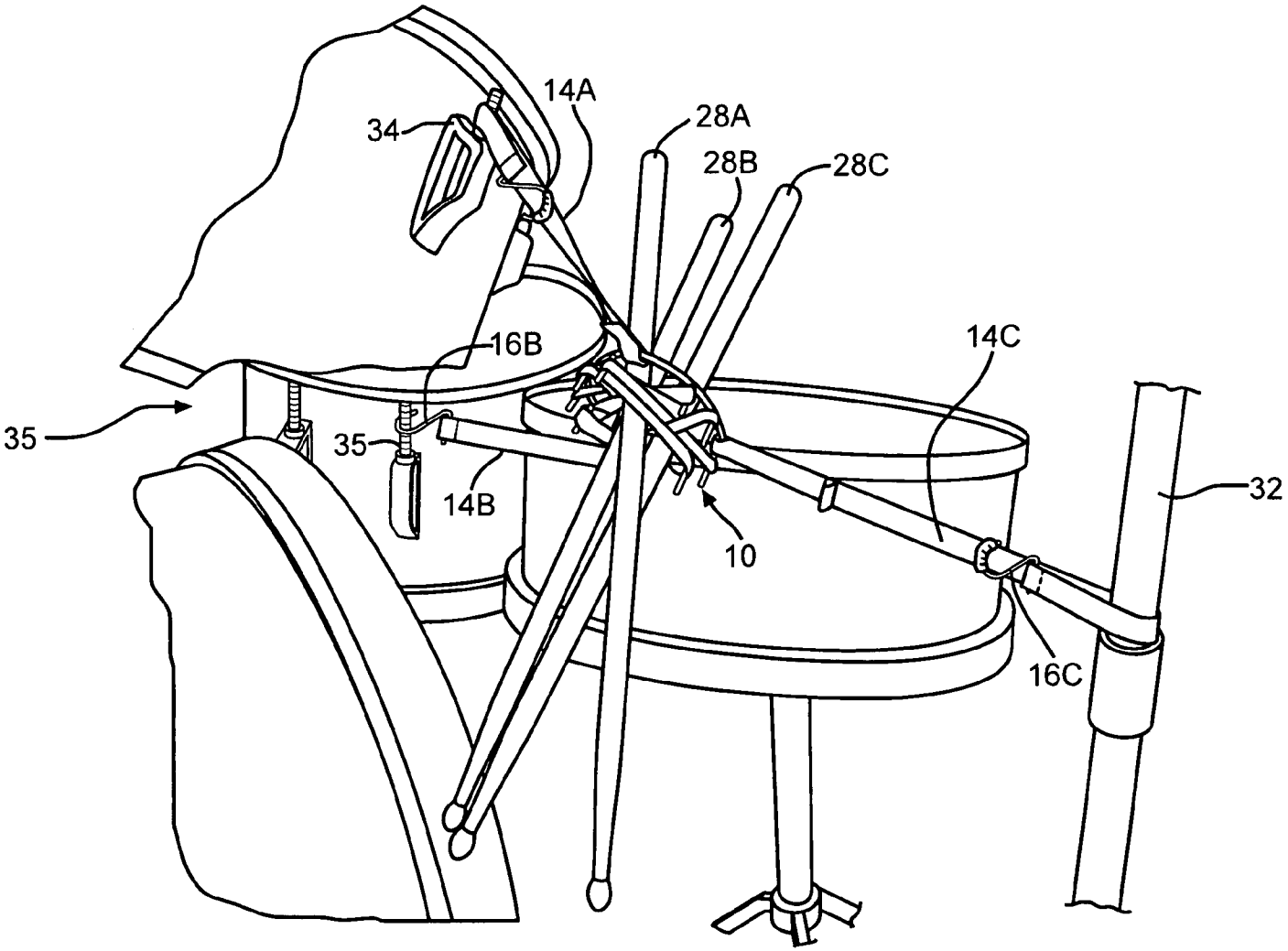
FIG. 8 presents a pictorial view of my drumstick holder having three drumsticks therein and attached to a typical drum stand.

FIG. 7 illustrates drumstick holder 10 having three drumsticks 28A, 28B, and 28C inserted therein. Drumsticks 28A, 28B, and 28C are inserted into the openings 35 between the woven elastic bands within frame 12 as illustrated. The elasticity of the elastic bands causes the bands to cinch around each of the drumsticks thereby holding them in place. The drumsticks are easily removed, when needed by pulling them out of the woven matrix of elastic bands FIG. 8 shows the subject drumstick holder 10, with drumsticks inserted therein, attached to a typical drum stand 35. Elastic straps 14 are secured to convenient locations on the drum stand. For example strap 14C is shown as being looped around a typical cymbal support stand 32 with hook 16C fastened to loop 18 sewn into strap 14C; strap 14A similarly looped around drumhead tensioning screw 34 and hook 16B, of strap 14B hooked upon drum head tensioning screw 35.

Thus drumstick holder 10, and its accompanying drumsticks, may be conveniently placed at arm's length. Further, the drumsticks may be easily inserted and/or removed from the drumstick holder.

Although a specific embodiment of the invention has been disclosed, there is no intent to thereby limit the invention to the specific embodiment illustrated herein. On the contrary, the intention herein is to cover all modifications, alternatives, embodiments, and/or equivalents of the subject invention as may fall within the spirit and scope of the invention as claimed below.

I claim:

1. Apparatus for holding a multiplicity of drum sticks for use by a drummer in a band comprising:

h) a circumscribing ring, i) a multiplicity of posts attached too and extending from said ring, said posts generally parallel to the center axis of said ring, j) an elongate elastic band stretchingly woven around and between said posts, in a generally diametric, crisscrossing pattern, thereby providing a woven matrix of openings, whereby said drum sticks may be removably inserted within the matrix of openings thereby securing said drum sticks therein.

2. The apparatus as claimed in claim 1 wherein said multiplicity of posts is grouped in pairs of two with said pairs spaced about the circumference of said ring.

3. The apparatus as claimed in claim 2 wherein said multiplicity of posts comprise eight posts, grouped into four groups of two posts in each group.

4. The apparatus as claimed in claim 3 wherein the posts, within each pair of posts, are separated by 10 degrees and each group of posts is separated by 90 degrees between centers.

5. Apparatus for holding a multiplicity of drum sticks for use by a drummer in a band comprising:

a) a circumscribing ring, b) a multiplicity of posts attached too and extending from said ring, said posts generally parallel to the center axis of said ring, c) an elongate elastic band stretchingly woven between said posts, in a generally diametric, crisscrossing pattern, thereby providing a woven matrix of openings, whereby said drum sticks may be removably inserted within the matrix of openings thereby securing said drum sticks therein d) said circumscribing ring having at least three elongated elastic straps, having attaching hooks at the terminal end thereof, spaced about, and attached too said ring, for attaching said ring to associated instruments.

* * * * *